US009291970B1

(12) United States Patent
Kawahata et al.

(10) Patent No.: US 9,291,970 B1
(45) Date of Patent: Mar. 22, 2016

(54) FIXING DEVICE AND IMAGE FORMING APPARATUS

(71) Applicant: FUJI XEROX CO., LTD., Tokyo (JP)

(72) Inventors: Yasushi Kawahata, Kanagawa (JP); Nobuhiro Katsuta, Kanagawa (JP); Keitaro Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/624,688

(22) Filed: Feb. 18, 2015

(30) Foreign Application Priority Data

Sep. 25, 2014 (JP) ..... 2014-195499

(51) Int. Cl.
*G03G 15/20* (2006.01)

(52) U.S. Cl.
CPC ..... *G03G 15/206* (2013.01)

(58) Field of Classification Search
USPC ..... 399/69, 122, 320, 328, 329, 341, 342, 399/400
See application file for complete search history.

(56) References Cited

U.S. PATENT DOCUMENTS

| | | | | |
|---|---|---|---|---|
| 5,842,098 | A | 11/1998 | Ueno et al. | |
| 8,897,683 | B2 * | 11/2014 | Chang et al. | 399/320 |
| 2011/0026991 | A1 | 2/2011 | Izawa et al. | |
| 2011/0064468 | A1 | 3/2011 | Kawahata et al. | |

FOREIGN PATENT DOCUMENTS

| | | | |
|---|---|---|---|
| JP | H06-102787 | | 4/1994 |
| JP | H10-123864 | A | 5/1998 |
| JP | 2003-280431 | A | 10/2003 |
| JP | 2011-033650 | A | 2/2011 |
| JP | 2011-059635 | A | 3/2011 |

* cited by examiner

*Primary Examiner* — Hoan Tran
(74) *Attorney, Agent, or Firm* — Oliff PLC

(57) ABSTRACT

Provided is a fixing device including a fixing unit that includes a pipe-shaped fixing member which includes an outermost layer including at least one selected from a group consisting of a hydrogenated nitrile rubber and a denatured hydrogenated nitrile rubber, and heats and pressurizes the recording medium to fix an unfixed developer image on a recording medium by bringing the outermost layer into contact with a surface of the recording medium which holds the developer image, the recording medium being transported while holding the unfixed developer image, and a heating unit that is disposed on an upstream side of the fixing unit in a transport direction of the recording medium, and heats the recording medium transported while holding the unfixed developer image.

6 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2014-195499 filed Sep. 25, 2014.

BACKGROUND (i) Technical Field

The present invention relates to a fixing device and an image forming apparatus.

(ii) Related Art

In the related art, as a unit that fixes an unfixed developer image formed on a recording medium, various fixing devices have been used.

In the fixing device, a fixing member that comes in contact with a developer image on a recording medium to heat and pressurize the recording medium, and fixes the developer image on the recording medium is used.

SUMMARY

According to an aspect of the invention, there is provided a fixing device including:

a fixing unit that includes a pipe-shaped fixing member which includes an outermost layer including at least one selected from a group consisting of a hydrogenated nitrile rubber and a denatured hydrogenated nitrile rubber, and heats and pressurizes the recording medium to fix an unfixed developer image on a recording medium by bringing the outermost layer into contact with a surface of the recording medium which holds the developer image, the recording medium being transported while holding the unfixed developer image; and a heating unit that is disposed on an upstream side of the fixing unit in a transport direction of the recording medium, and heats the recording medium transported while holding the unfixed developer image, the heating unit heating by at least one heating member selected from a group consisting of a heating member that heats the recording medium in a non-contact manner, a heating member that comes in contact with a surface opposite to the surface of the recording medium which holds the developer image to heat the recording medium, and a heating member that comes in contact with the surface of the recording medium which holds the developer image with a pressurizing pressure lower than a pressurizing pressure of the fixing member to heat the recording medium.

BRIEF DESCRIPTION OF THE DRAWINGS

Exemplary embodiments of the present invention will be described in detail based on the following figures, wherein.

DETAILED DESCRIPTION

Figure 1:
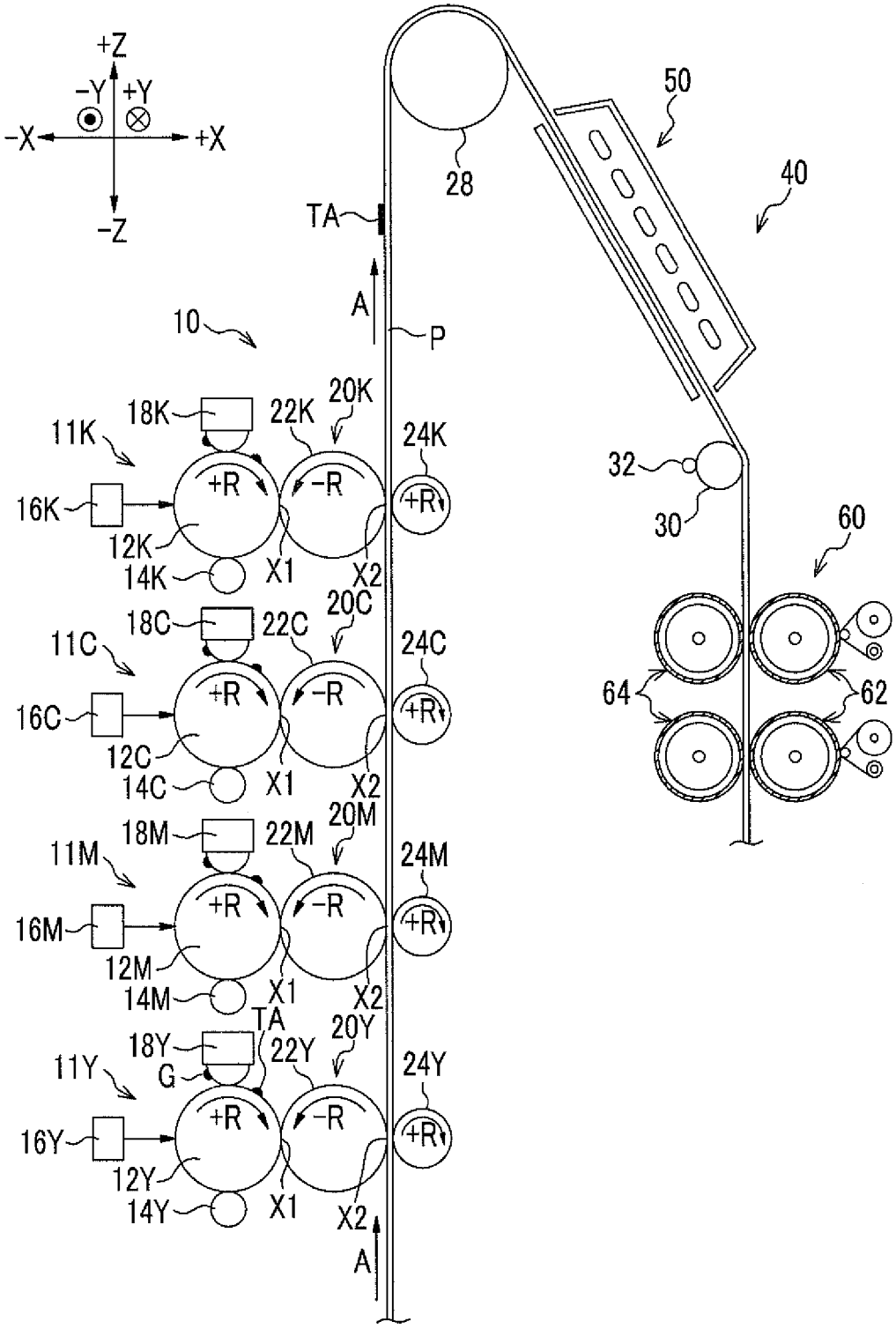
FIG. 1 is a schematic diagram showing the entire configuration of an image forming apparatus according to a first exemplary embodiment.

Hereinafter, exemplary embodiments of the present invention will be described.

A fixing device according to the present exemplary embodiment includes a fixing unit, and a heating unit (hereinafter, simply referred to as a "preliminary heating unit") that is disposed on an upstream side of the fixing unit in a transport direction of a recording medium.

The fixing unit includes a pipe-shaped fixing member, and heats and pressurizes the recording medium to fix an unfixed developer image on the recording medium by bringing an outermost surface (outermost layer) into contact with a surface of the recording medium which holds the developer image. Here, the recording medium is transported while holding the unfixed developer image. The fixing member includes the outermost layer including at least one selected from a group consisting of a hydrogenated nitrile rubber and a denatured hydrogenated nitrile rubber.

The heating unit (preliminary heating unit) heats the recording medium transported while holding the unfixed developer image on the upstream side of the fixing unit. The heating unit includes at least one selected from a group consisting of a heating member (non-contact heating member) that heats the recording medium in a non-contact manner, a heating member (rear contact heating member) that comes in contact with a surface opposite to the surface of the recording medium which holds the developer image to heat the recording medium, and a heating member (developer-image-surface contact heating member) that comes in contact with the surface of the recording medium which holds the developer image with a lower pressurizing pressure than that of the fixing member to heat the recording medium.

In the image forming apparatus, after the unfixed developer image is formed on the recording medium by an electrophotographic method, the fixing device that fixes the developer image on the recording medium by bringing the fixing member into contact with the surface of the recording medium which holds the developer image to heat and pressurize the recording medium is used. As the fixing member, a fixing member in which an elastic layer made from a silicone rubber or a fluororubber is formed in an outer circumference of a core made from metal, or a fixing member in which a fluororesin layer such as PFA or PTFE as an outermost layer is formed on the elastic layer is generally used. In order to fix the developer image, a temperature of the fixing member is required to be a high temperature of, for example, 150° C. or more, and, thus, it is necessary to select a material having excellent heat resistance, such as a silicone rubber, a fluororubber or a fluororesin. Particularly, as a transport speed of the recording medium becomes higher, the fixing is particularly required at a high temperature of, for example, 150° C. or more. The higher-temperature fixing is required for a multi-color image.

However, in the fixing member whose outermost layer is made from a silicone rubber, a fluororubber or a fluororesin, wearing-out of the fixing member may occur due to friction between the fixing member and the recording medium and friction between the edge of the recording medium and the fixing member while the image formation is repeated. Since the fixing is not favorably performed in the worn portion as compared to another portion, gloss non-uniformity may be generated in a formed image.

In contrast, in accordance with the fixing device according to the present exemplary embodiment, since the fixing member that includes the outermost layer including at least one selected from a group consisting of a hydrogenated nitrile rubber and a denatured hydrogenated nitrile rubber is used, it is possible to obtain the fixing member having excellent wear resistance. As a result, it is possible to suppress the occurrence of gloss non-uniformity in the image.

In general, since a heat resisting temperature of the hydrogenated nitrile rubber or the denatured hydrogenated nitrile rubber is approximately from 150° C. to 160° C., a set temperature of the fixing member that includes the outermost layer including these materials is adjusted to, for example, 150° C., and, thus, it is expected that the degradation of the outermost layer will be suppressed. However, when the outermost layer including the hydrogenated nitrile rubber or the denatured hydrogenated nitrile rubber is used, even though the set temperature of the fixing member is adjusted to 150° C., the outermost layer is degraded to be cured while the image formation is repeated, and fracturing or damage may occur in the outermost layer.

In contrast, in the fixing device according to the present exemplary embodiment, by combining a preliminary heating unit in addition to the fixing member, it may be seen that it is possible to suppress the degradation of the outermost layer including at least one selected from a group consisting of the hydrogenated nitrile rubber or the denatured hydrogenated nitrile rubber. Further, it is possible to suppress the occurrence of fracturing or damage.

In order to exhibit these effects, the following observations are assumed to be necessary although not necessarily clarified.

In the fixing device, by thermally conducting a large amount of heat to the recording medium coming in contact with the surface of the fixing member set to a high temperature (for example, 150° C.), the developer image is fixed by being melted. In the fixing member after the heat is thermally conducted to the recording medium, in order to supply the heat to the surface again, the heat is supplied from a heat supplying unit such as a heater provided inside the fixing member. Thus, a temperature gradient may occur in a radial direction (direction from the inside toward the outermost surface) of the fixing member, and as the transport speed becomes higher, such a temperature gradient is increased. In the fixing device that does not include the preliminary heating unit on the upstream side of the fixing unit, since a temperature difference between the fixing member and the recording medium is large, the amount of heat conducted to the recording medium from the surface of the fixing member is increased. For this reason, when the image formation is finished and the fixing device is stopped, a large amount of heat is moved to the surface from the inside of the fixing member according to the high-temperature gradient generated as described above, and the surface of the fixing member enters an overheated state. Thus, it is assumed that the temperature of the outermost layer temporarily has a temperature exceeding the set temperature. Accordingly, even when the hydrogenated nitrile rubber or the denatured hydrogenated nitrile rubber in which the heat resisting temperature falls within the aforementioned range is used as the outermost layer and the set temperature of the fixing member is adjusted, it is considered that the outermost layer is degraded to cause the fracturing or damage while the image formation is repeated.

In contrast, in the present exemplary embodiment, the preliminary heating unit is provided. Thus, it is considered that since a temperature difference between the fixing member and the recording medium before corning in contact with the fixing member is smaller than that when the preliminary heating unit is not provided, the temperature gradient occurring within the fixing member is suppressed to be smaller. Accordingly, it is considered that since the overheated state on the surface occurring when the image formation is finished to stop the fixing device is suppressed, the degradation of the outermost layer is suppressed, and the occurrence of fracturing or damage is suppressed.

In the present exemplary embodiment, with a configuration described above, it is possible to suppress the degradation, fracturing and damage of the outermost layer while suppressing the occurrence of gloss non-uniformity due to wearing-out of the outermost layer.

Temperature of Recording Medium

Here, a temperature difference between the fixing member and the recording medium before coming in contact with the fixing member will be described.

When the following case (a) or (b) is satisfied, a temperature of a lowest-temperature portion of the recording medium of the following (A) or (B) is preferably equal to or greater than a temperature obtained by subtracting 30° C. from a set temperature of the fixing member, more preferably equal to or greater than a temperature obtained by subtracting 10° C. from a set temperature of the fixing member, and even more preferably equal to or greater than a temperature obtained by subtracting ±0° C. from a set temperature of the fixing member. The upper limit value is preferably equal to or less than 140° C., more preferably equal to or less than 130° C., and even more preferably equal to or less than 120° C. By allowing the temperature to fall within the aforementioned range, a temperature difference between the fixing member and the recording medium is controlled to be smaller, and the occurrence of the degradation of the outermost layer is suppressed.

(a) when a member that exchanges heat with the recording medium is provided on an upstream side of the fixing unit and a downstream side of the heating unit in the transport direction of the recording medium: (A) the recording medium before coming in contact with the fixing member after the heat is exchanged by the member (b) when a member that exchanges heat with the recording medium is not provided on an upstream side of the fixing unit and a downstream side of the heating unit in the transport direction of the recording medium: (B) the recording medium before coming in contact with the fixing member after the heating is performed by the heating unit.

As a member that exchanges heat with the recording medium, a winding roll 30 shown in FIGS. 1, 2, 4 and 5 to be described below and a temperature converging unit 110 shown in FIGS. 4 and 5 may be used.

Here, a timing at which the temperature of the recording medium is measured will be described. In the image forming apparatus including the fixing unit and the preliminary heating unit, the temperature of the recording medium during period before the recording medium comes in contact with the fixing member after the heating is performed by the preliminary heating unit typically changes to only a negligible extent. For this reason, the temperature of the recording medium may be measured at any timing as long as the timing falls within the aforementioned period.

When the member that exchanges heat with the recording medium is provided between the preliminary heating unit and the fixing member (the case (a)), the recording medium after the heat is exchanged by the member is measured.

However, in the fixing device in which there is a long interval during a period until the recording medium comes in contact with the fixing member after the heating is performed by the preliminary heating unit, when the temperature of the recording medium changes to a non-negligible extent during the period until the recording medium comes in contact with the fixing member after the heating is performed by the preliminary heating unit, the temperature of the recording medium in a position close to the fixing member where the temperature change is reduced to a negligible extent is measured.

Hereinafter, a fixing device and an image forming apparatus according to the present exemplary embodiment will be described with reference to the drawings.

First Exemplary Embodiment

Examples of a fixing device and an image forming apparatus according to the first exemplary embodiment will be described with reference to the drawings. The entire configuration and operation of the image forming apparatus will be initially described, and the configuration and operation of the fixing device which is a major component of the present exemplary embodiment will be subsequently described.

In the following description, it is assumed that a direction represented by arrow Z in FIG. 1 is a height direction of the apparatus and a direction represented by arrow X in FIG. 1 is a width direction of the apparatus. Further, it is assumed that a direction (represented by Y) that is perpendicular to the apparatus height direction and the apparatus width direction is a depth direction of the apparatus. When an image forming apparatus 10 is viewed from a side on which a user (not shown) stands (in a front view), the apparatus height direction, the apparatus width direction and the apparatus depth direction are respectively described as a Z direction, an X direction and a Y direction.

When it is necessary to distinguish one side of the X direction, the Y direction or the Z direction from the other side thereof, in a front view of the image forming apparatus 10, an upper side is described as a +Z side, a lower side is described as a −Z side, a right side is described as a +X side, a left side is described as a −X side, a back side is described as a +Y side, and a front side is described as a −Y side.

Entire Configuration

As shown in FIG. 1, the image forming apparatus 10 includes four image forming units 11Y, 11M, 11C and 11K, a transport roll 28, the winding roll 30, and a fixing device 40. The image forming units 11Y, 11M, 11C and 11K are examples of developer image forming units. The transport roll 28 is a part of a transport device (not shown) that transports sheet P. The detail of the winding roll 30 will be described below.

A suffix letter "Y" of reference numerals denotes a unit for yellow, "M" denotes a unit for magenta, "C" denotes a unit for cyan, and "K" denotes a unit for black. In the image forming apparatus 10, the respective units corresponding to the respective colors are arranged in order of Y, M, C and K from an upstream side in a transport direction of the sheet P to be described below.

The transport device (not shown) transports the sheet p as an example of the recording medium at a predetermined transport speed in an illustrated arrow A direction (transport direction). The sheet P is a continuous sheet. For example, the sheet is transported from the −Z side to the +Z side on an upstream side of the transport roll 28 in the transport direction, and is transported from the +Z side to the −Z side on a downstream side of the transport roll 28. For example, the transport speed of the sheet P is set to 60 [m/min].

In the transport direction of the sheet P, the transport roll 28 is disposed on a downstream side of the four image forming units 11Y, 11M, 11C and 11K, and the fixing device 40 is disposed on a downstream side of the transport roll 28. Operations of the respective components of the image forming apparatus 10 are controlled by a control unit (not shown).

The image forming units 11Y, 11M, 11C and 11K include cylindrical photoconductors 12Y, 12M, 12C and 12K that hold electrostatic latent images, charge devices 14Y, 14M, 14C and 14K, and exposure devices 16Y, 16M, 16C and 16K. The image forming units 11Y, 11M, 11C and 11K include developing devices 18Y, 18M, 18C and 18K, and transfer devices 20Y, 20M, 20C and 20K, respectively.

Photoconductor The photoconductors 12Y, 12M, 12C and 12K are rotatable in an arrow +R direction (clockwise direction) in the drawing, respectively. The charge devices 14Y, 14M, 14C and 14K, the exposure devices 16Y, 16M, 16C and 16K and the developing devices 18Y, 18M, 18C and 18K are sequentially arranged around the photoconductors 12Y, 12M, 12C and 12K in the +R direction. The transfer devices 20Y, 20M, 20C and 20K are arranged around the photoconductors 12Y, 12M, 12C and 12K so as to be arranged between the developing devices 18Y, 18M, 18C and 18K and the charge devices 14Y, 14M, 14C and 14K in the +R direction.

Charge Device and Exposure Device

The charge devices 14Y, 14M, 14C and 14K are, for example, rolls to which a voltage is applied, and are units that charge outer circumferential surfaces of the photoconductors 12Y, 12M, 12C and 12K. The exposure devices 16Y, 16M, 16C and 16K expose the outer circumferential surfaces of the photoconductors 12Y, 12M, 12C and 12K which are charged by the charge devices 14Y, 14M, 14C and 14K based on image data to form the electrostatic latent images.

Developing Device

The developing devices 18Y, 18M, 18C and 18K develop the electrostatic latent images formed on the outer circumferential surfaces of the photoconductors 12Y, 12M, 12C and 12K by the exposure devices 16Y, 16M, 16C and 16K with developer G to obtain visible toner images TA. The toner image TA is an example of a developer image. The developer G used in the developing devices 18Y, 18M, 18C and 18K includes, for example, powder toner T (see FIG. 3) which contains 9[% by weight] of waxes WX (see FIG. 3) and includes a polyester resin (binder resin) as a main component.

The waxes WX may be natural waxes or synthetic waxes. For example, the waxes WX include paraffin waxes and microcrystalline waxes which are petroleum waxes, Carnauba waxes and candelilla waxes which are plant-derived waxes, beeswaxes and spermaceti which are animal-derived waxes, and polyethylene waxes and amide waxes which are synthetic waxes. Denatured waxes or mixed waxes of the aforementioned waxes may be used. In the present exemplary embodiment, the waxes WX are, for example, paraffin waxes.

The waxes WX having an appropriate melting point are preferably selected in consideration of a softening point of the binder resin of the toner T. When toner T having no waxes WX is used, a member coming in contact with an unfixed toner image TA or a unit that coats the toner image TA with releasing oil is preferably provided on an upstream side of a fixing unit 60 (see FIG. 2) to be described below. Instead of the waxes WX, a liquid developer which includes a carrier liquid containing oil may be used.

Transfer Device

The transfer devices 20Y, 20W, 20C and 20K include intermediate transfer rolls 22Y, 22M, 22C and 22K, and transfer rolls 24Y, 24M, 24C and 24K. Since the transfer device 20Y has the same configuration as those of the transfer devices 20M, 20C and 20K except for the toner T (see FIG. 3), the transfer device 20Y will be described below, and the transfer devices 20M, 20C and 20K will not be described.

The intermediate transfer roll 22Y comes in contact with the photoconductor 12Y in a primary transfer position X1 which is on an upstream side of the charge device 14Y in a rotational direction of the photoconductor 12Y and is on a downstream side of the developing device 18Y, and is driven-rotated in a direction (counterclockwise direction) indicated by an arrow −R. Thus, in the transfer device 20Y, the toner image TA formed on the outer circumferential surface of the photoconductor 12Y through developing is primarily transferred onto the intermediate transfer roll 22Y in the primary transfer position X1. A primary transfer voltage (bias voltage) is applied between the photoconductor 12Y and the intermediate transfer roll 22Y from a power supply (not shown).

The transfer roll 24Y is disposed on an opposite side to the photoconductor 12Y to face the intermediate transfer roll 22Y. When the sheet P is fed between the intermediate transfer roll 22Y and the transfer roll 24Y, the transfer roll 24Y rotates in a direction indicated by the arrow +R. Here, a position where the intermediate transfer roll 22Y and the sheet P come in contact with each other is a secondary transfer position X2, and the toner image TA which is primarily transferred onto the intermediate transfer roll 22Y is secondarily transferred onto the sheet P in the secondary transfer position X2. A secondary transfer voltage (bias voltage) is applied between the intermediate transfer roll 22Y and the transfer roll 24Y.

Here, a transport path of the sheet P is disposed in the Z direction up to the transport roll 28, and is disposed in an inclined direction which is inclined on the −Z side toward the +X side from the transport roll 28 up to the winding roll 30 to be described below. The transport path of the sheet P is disposed in the Z direction on a downstream side of the winding roll 30.

Image Forming Operation

In the image forming apparatus 10, an image is formed as follows.

In the image forming unit 11Y, the photoconductor 12Y rotates, and the outer circumferential surface of the photoconductor 12Y is charged by the charge device 14Y. Subsequently, the charged outer circumferential surface of the photoconductor 12Y is exposed and scanned by the exposure device 16Y, and, thus, an electrostatic latent image (not shown) of a first color (Y) is formed on the outer circumferential surface of the photoconductor 12Y. The electrostatic latent image is developed by the developing device 18Y, and a visualized toner image TA is formed on a surface of the photoconductor 12Y.

The toner image TA reaches the primary transfer position X1 by the rotation of the photoconductor 12Y, and is primarily transferred onto the intermediate transfer roll 22Y with the primary transfer voltage. The toner image TA transferred onto the intermediate transfer roll 22Y reaches the secondary transfer position X2 by the rotation of the intermediate transfer roll 22Y, and is secondarily transferred onto the sheet P with the secondary transfer voltage.

Similarly, toner images TA of a second color (M), a third color (C) and a fourth color (K) that are formed by the image forming units 11M, 11C and 11K are sequentially transferred onto the sheet P to overlap with one another through the intermediate transfer roll 22M, 22C and 22K. The transport speed of the sheet P is synchronized with the rotational speeds of the photoconductors 12Y, 12M, 12C and 12K such that positions of the toner images TA of the respective colors are not deviated from each other on the sheet P. Thus, multiple toner images TA are formed. The multiple toner images TA are fixed onto the sheet P in the fixing device 40 to be described below through a heating process and a pressurizing process.

The photoconductor 12Y in which the primary transfer of the toner image TA onto the intermediate transfer roll 22Y is finished is cleaned by a cleaner (not shown). The outer circumferential surface of the intermediate transfer roll 22 in which the secondary transfer of the toner image TA onto the sheet P is finished is cleaned by a cleaner (not shown).

When a single color image is formed on the sheet P, for example, when an image of black (K) is formed, the other image forming units 11Y, 11M and 11C are separated (retracted) from the intermediate transfer rolls 22Y, 22M and 22C.

Configuration of Major Component

Next, the fixing device 40 will be described.

Figure 2:
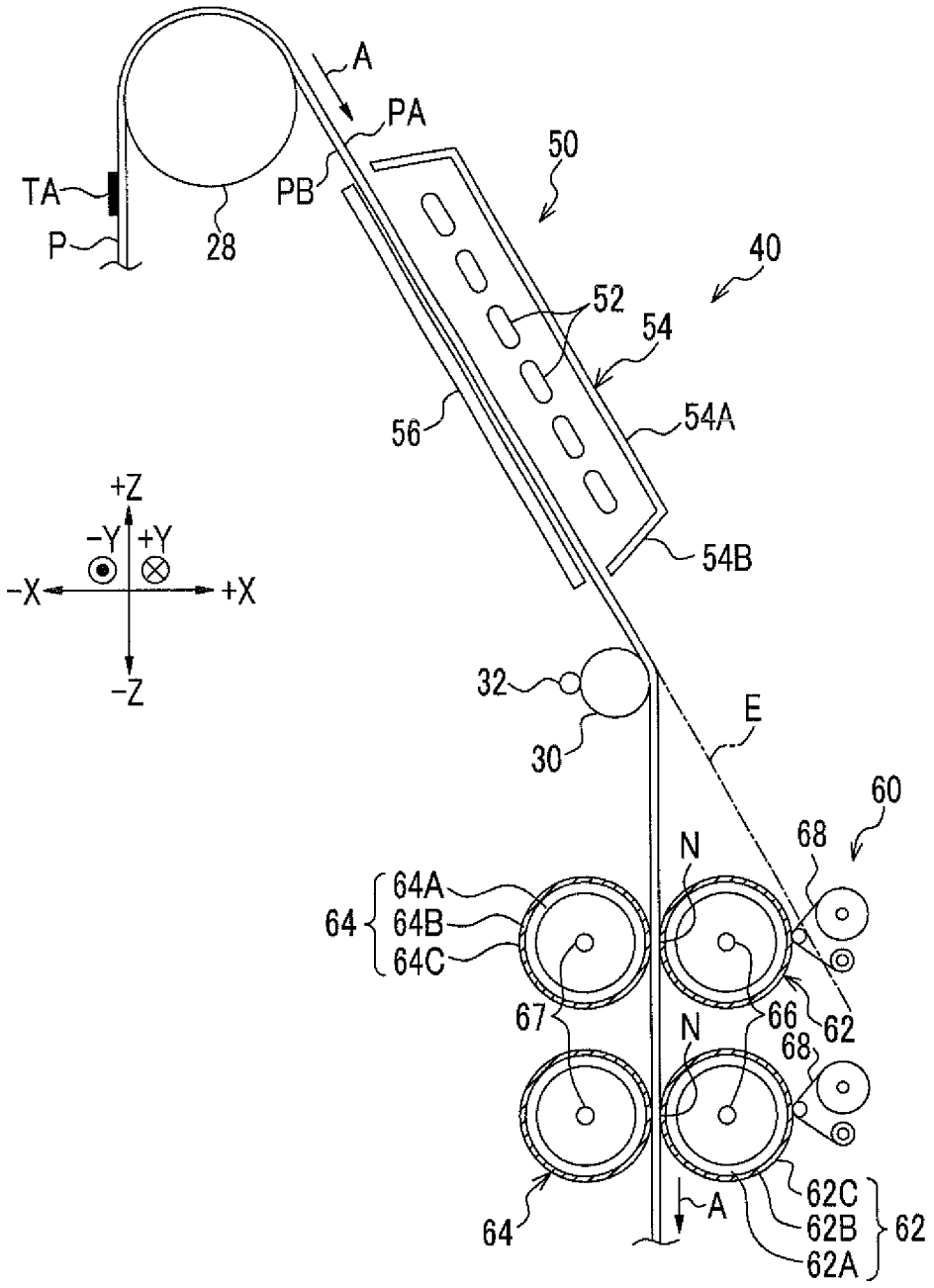
FIG. 2 is a schematic diagram showing the configuration of a fixing device according to the first exemplary embodiment.

As shown in FIG. 2, the fixing device 40 includes, for example, a preliminary heating unit 50 as an example of the heating unit, the fixing unit 60 that fixes the toner images TA heated in the preliminary heating unit 50 onto the sheet P, and the winding roll 30 as an example of a bending member and a rotating member.

Preliminary Heating Unit

The preliminary heating unit 50 includes, for example, six carbon heaters 52. The six carbon heaters 52 are provided on an upstream side of the fixing unit 60 in the transport direction (A direction) of the sheet P to face the toner images TA of the sheet P with a set interval in the transport direction, and are arranged so as not to come in contact with the sheet P. The carbon heaters 52 irradiate the sheet P with far-infrared rays by applying electricity to heat the sheet P and the toner images TA. In the following description, a surface of the sheet P on which the toner images TA are formed is referred to as an image surface PA, and a surface (rear surface of the image surface PA) on which the toner images TA are not formed is referred to as a non-image surface PB.

In the present exemplary embodiment, an output and a heating temperature of the carbon heaters 52 are set such that, for example, a white background portion is heated to 90[° C.] and a black portion of the toner images TA is heated to 110[° C.] on the image surface PA. That is, the preliminary heating unit 50 heats the toner images TA at a lower temperature than the fixing temperature of the fixing unit 60 to be described below. Specifically, the carbon heaters 52 have a rated power of 4 [KW] and a Y-direction length of 600 [mm].

After the heating is performed by the preliminary heating unit 50, a temperature of a lowest-temperature portion (typically indicates the white background portion) of the sheet P before coming in contact with a fixing roll 62 is preferably equal to or greater than a temperature obtained by subtracting 30° C. from a setting temperature of the fixing roll 62, and is preferably equal to or less than 140° C.

Here, in the first exemplary embodiment, since the winding roll 30 as an example of a member that exchanges heat with the sheet P is disposed between the preliminary heating unit 50 and the fixing roll 62, the temperature of the lowest-temperature portion of the sheet before coming in contact with the fixing roll refers to a temperature of the lowest-temperature portion (white background portion) of the sheet P after heat is exchanged to the winding roll 30.

The six carbon heaters 52 are covered with a cover 54. The cover 54 includes a flat plate section 54A that covers an opposite side to the sheet P of the carbon heaters 52, and inclined sections 54B that obliquely extend toward the sheet P from ends of the flat plate section 54A. Gaps are formed between front ends of the inclined sections 54B and the image surface PA of the sheet P.

A reflection plate 56 is provided on the non-image surface PB side of the sheet P in a position which faces the six carbon heaters 52. The reflection plate 56 is made from a plate material of material A1050P on which specular surface processing is performed. The reflection plate 56 is disposed in the transport direction with a gap of 10 [mm] from the sheet P.

Here, a line that extends the transport path of the sheet P facing the preliminary heating unit 50 toward a downstream side is expressed as an extension line E. The transport roll 28 and the winding roll 30 to be described below are disposed on the same side with respect to the common tangent lines, and the extension line E is a line that extends a common tangent line close to the carbon heaters 52 among common tangent lines of the transport roll 28 and the winding roll 30. The extension line F is a line in two dimensions (X-Z surface), but is an extension surface in three dimensions.

Fixing Unit

The fixing unit 60 includes the fixing rolls 62 as examples of the fixing members, and pressure rolls 64 that pressurize the sheet P while the sheet is interposed between the pressure roll and the fixing roll 62. For example, in the fixing unit 60, a pair of fixing rolls 62 and a pair of pressure rolls 64 are arranged with a set interval in the transport direction (A direction) of the sheet P.

Each of the fixing rolls 62 includes an outermost layer 62C that contains at least one selected from a group consisting of a denatured hydrogenated nitrile rubber and a hydrogenated nitrile rubber.

Fixing Roll

The fixing rolls 62 are formed in a cylindrical shape, and are arranged on a downstream side of the preliminary heating unit 50 and the winding roll 30 in the transport direction of the sheet P and on the +X side of the sheet P to be rotated with the Y direction as an axial direction. Outermost layers of the fixing rolls 62 come in contact with the image surface PA of the sheet P to heat and pressurize the sheet, and the toner images TA are fixed onto the sheet P.

The term "heating" in the fixing rolls 62 (fixing member) means that the sheet comes in contact with the fixing rolls 62 (fixing member) having a temperature capable of fixing the unfixed toner images TA (developer images), and the fixing rolls 62 (fixing member) do not necessarily have a higher temperature than that of the sheet P (recording medium) or the toner images TA (developer images).

The fixing roll 62 has a multi-layer structure including a core roll 62A, an elastic layer 62B and the outermost layer 62C from the inside toward the outside in a radial direction. That is, in the fixing roll 62, the outermost layer 62C that comes in contact with the toner images TA and the waxes WX (see FIG. 3) is formed on an outer circumferential surface of the elastic layer 62B.

Core Roll

The core roll 62A is a cylindrical member, and supports the elastic layer 62B and the outermost layer 62C which are arranged on an outer circumferential surface.

The core roll 62A is configured such that hubs (portions to which the bearings are attached) made from SUS (stainless steel) are provided at both ends of a pipe member made from an aluminum alloy in an axial direction. However, the material of the core roll 62A is not limited to the aforementioned material, and may be another material. For example, the material of the core roll may include aluminum (A-5052 and the like), metal such as iron, SUS or copper, an alloy, a ceramic, and FRM (fiber reinforced metal), or may include a resin.

The shape of the core roll 62A is not limited to the cylindrical shape (hollow), and may be a columnar shape (solid).

Elastic Layer

The elastic layer 62B is made from, for example, a silicone rubber having a thickness of 4 [mm] in a radial direction and a shore A hardness of A30. However, the material of the elastic layer 62B is not limited to the aforementioned material, and may be another material. For example, as the material of the elastic layer, various rubber materials may be used. The various rubber materials include a urethane rubber, an ethylene-propylene rubber (EPM), a silicone rubber and a fluororubber (FKM), and may particularly include a silicone rubber having excellent heat resistance and excellent processability. Examples of the silicone rubber include an RTV silicone rubber and an HTV silicone rubber, and specifically include a polydimethyl silicone rubber (MQ), a methylvinyl silicone rubber (VMQ), a methylphenyl silicone rubber (PMQ) and a fluorosilicone rubber (FVMQ).

An adhesive layer may be formed between the core roll 62A and the elastic layer 62B.

Outermost Layer

A composition of the outermost layer 62C will be described. The outermost layer 62C includes at least one selected from a group consisting of a hydrogenated nitrile rubber (HNBR) and a denatured hydrogenated nitrile rubber (denatured HNBR).

The hydrogenated nitrile rubber (HNBR) refers to a copolymer in which at least a part of butadiene in acrylonitrile-butadiene copolymer (NBR) is hydrogenated.

Specific examples of the hydrogenated nitrile rubber (HNBR) include Zetpol 0020, Zetpol 1000L, Zetpol 1010, Zetpol 1020, Zetpol 2000, Zetpol 2000L, Zetpol 2010, Zetpol 2010L, Zetpol 2010H, Zetpol 2011, Zetpol 2020, Zetpol 2020L, Zetpol 2030L, Zetpol 3300, Zetpol 3310, Zetpol 4300 and Zetpol 4310 which are manufactured by ZEON CORPORATION.

The denatured hydrogenated nitrile rubber (denatured HNBR) refers to a copolymer which is denatured by dispersing and cross-linking another polymer component in the hydrogenated nitrile rubber (HNBR). Examples of another polymer component used for denaturing include methacrylic acid zinc.

Specific examples of the denatured hydrogenated nitrile rubber (denatured HNBR) include Zeoforte ZSC1295N, Zeoforte ZSC2095, Zeoforte ZSC2195H, Zeoforte ZSC2295, Zeoforte ZSC2295CX, Zeoforte ZSC2295L, Zeoforte ZSC2298L, Zeoforte ZSC2395, Zeoforte ZSC3195CX, and Zeoforte ZSC4195CX which are manufactured by ZENON CORPORATION.

A resin mixture obtained by mixing at least one of the hydrogenated nitrile rubber (HNBR) and the denatured hydrogenated nitrile rubber (denatured HNBR) with another resin may be used. Examples of another resin to be mixed in include polyvinyl chloride (PVC).

Specific examples of a resin mixture obtained by mixing the hydrogenated nitrile rubber (HNBR) with another resin include Zetpol PBZ123 manufactured by ZENON CORPORATION.

Preferably, the outermost layer 62C includes hydrogenated nitrile rubber (HNBR) and denatured hydrogenated nitrile rubber (denatured HNBR) as main components. Specifically, the content of the hydrogenated nitrile rubber and the denatured hydrogenated nitrile rubber in the outermost layer 62C is preferably equal to or greater than 50% by weight, and more preferably equal to or greater than 75% by weight.

Another additive may be added to the outermost layer 62C in order to obtain strength. Specific examples of the additive include carbon black particles, silica and calcium carbonate.

An addition amount of the another additive to the outermost layer 62C is preferably from 5% by weight to 60% by weight, and more preferably from 20% by weight to 30% by weight.

The method of forming the outermost layer 62C on the elastic layer 62B is not particularly limited, and the outermost layer may be formed on the elastic layer by a known method in the related art. For example, the outermost layer is formed by dissolving or dispersing at least one selected from a group consisting of the hydrogenated nitrile rubber (HNBR) and the denatured hydrogenated nitrile rubber (denatured HNBR) and the another additive to be added in a liquid, coating the elastic layer 62B with the liquid, and then drying the coated liquid.

For example, the thickness of the outermost layer 62C is preferably from 10 μm to 200 μm, and more preferably from 20 μm to 100 μm.

For example, the fixing roll 62 has an outer diameter of 108 [mm] and a length of 580 [mm] in an axial direction.

A halogen heater 66 as an example of an internal heat supplying unit is provided inside the fixing roll 62. The halogen heater 66 generates heat by applying electricity from the power supply (not shown) to heat the fixing roll 62 from the inside. For example, the halogen heater 66 is feedback-controlled based on an output of a temperature sensor (not shown) that detects a temperature of the fixing roll 62 such that an outer circumferential surface of the fixing roll 62 is maintained at a temperature of 120[° C.].

Cleaning webs 68 come in contact with portions of the outer circumferential surfaces of the fixing rolls 62 opposite to the pressure rolls 64, respectively. The cleaning webs 68 remove the waxes adhering to the outer circumferential surfaces of the fixing rolls 62.

Pressure Roll

The pressure rolls 64 have a cylindrical shape, and are arranged on the −X side of the sheet P to be rotated with the Y direction as an axial direction. The pressure roll 64 has a multi-layer structure including a core roll 64A, an elastic layer 64B and an outermost layer 64C from the inside toward the outside in a radial direction. The pressure rolls 64 are urged toward the fixing rolls 62 by using urging units such as springs (not shown). For example, in the present exemplary embodiment, since the core roll 64A, the elastic layer 64B and the outermost layer 64C respectively have the same configurations as those of the core roll 62A, the elastic layer 62B and the outermost layer 62C, the description thereof will be omitted. A halogen heater 67 is provided inside the pressure roll 64.

The halogen heater 67 generates heat by applying electricity from the power supply (not shown) to heat the pressure roll 64 from the inside. For example, the halogen heater 67 is feedback-controlled based on an output of a temperature sensor (not shown) that detects a temperature of the pressure roll 64 such that an outer circumferential surface of the pressure roll 64 is maintained at a temperature of 120[° C.].

A latch mechanism (not shown) that comes in contact with or is separated from the fixing roll 62 is provided at the pressure roll 64, and, thus, the fixing roll 62 and the pressure roll 64 may come in contact with each other and the pressure roll 64 may retract from the fixing roll 62. A load is applied to contact portions N (nip portions) where the fixing rolls 62 and the pressure rolls 64 come in contact with each other in a steady load manner, and a load value is, for example, 2450 [N]. The fixing roll 62 and the pressure roll 64 may have a latch structure in which the fixing roll and the pressure roll come in contact with or retract from the sheet P.

Winding Roll

The winding roll 30 is formed in, for example, a cylindrical shape, and is disposed on the −X side of the sheet P between the preliminary heating unit 50 and the fixing roll 62 to be rotated with the Y direction as an axial direction. Specifically, the winding roll 30 is disposed in a position which is on the +X side and the −Z side with respect to the front ends of the inclined sections 54B of the cover 54 and is on the +Z side of the pressure roll 64. The winding roll 30 is made from, for example, SUS (stainless steel).

An outer circumferential surface of a cleaning roll 32 as an example of a cleaning unit comes in contact with an opposite side (−X side) of an outer circumferential surface of the winding roll 30 to a side coming in contact with the sheet P. For example, a rubber material including a release layer on an outer circumferential surface of a core bar made from SUS is provided at the cleaning roll 32. The cleaning roll 32 is driven-rotated with the Y direction as an axial direction by the rotation of the winding roll 30.

The sheet P is wound around the outer circumferential surface of the winding roll 30, and, thus, the winding roll 30 bends the transport path of the sheet P from the preliminary heating unit 50 to the fixing rolls 62 toward an opposite side (−X side) to the image surface PA side (+X side) with respect to the extension line E of the transport path facing the preliminary heating unit 50. Thus, the outer circumferential surface of the fixing roll 62 is positioned closer to the image surface PA than the extension line E. The sheet P is transported while the winding roll 30 comes in contact with the sheet P, and, thus, the winding roll 30 is driven-rotated by the movement of the sheet P.

Operation

Next, an operation of the first exemplary embodiment will be described.

As shown in FIG. 1, the transport of the sheet P is started by the rotation of the transport roll 28, and the toner images TA are formed on the sheet P in the image forming units 11Y, 11M, 11C and 11K. The transport speed of the sheet P is, for example, 60 [m/min].

Subsequently, as shown in FIG. 2, the carbon heaters 52 of the preliminary heating unit 50 are turned on. The pressure roll 64 and the fixing roll 62 of the fixing unit 60 perform a latching operation (contact operation). Thus, the fixing roll 62 and the pressure roll 64 are rotated by the movement of the sheet P.

Figure 3:
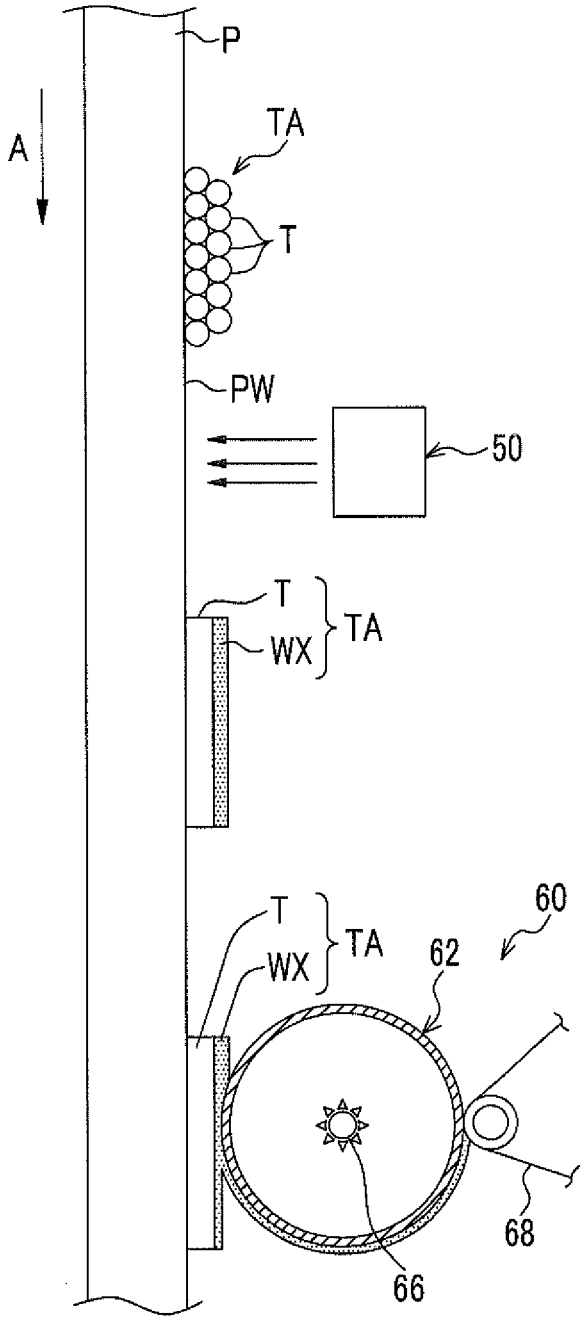
FIG. 3 is a schematic diagram showing a state where toner on a sheet from a heating unit to a fixing unit according to the first exemplary embodiment is melted.

Thereafter, as shown in FIG. 3, the toner images TA on the sheet P are heated by the preliminary heating unit 50. Here, as mentioned above, the output of the carbon heaters 52 (see FIG. 2) of the preliminary heating unit 50 is set such that a white background portion PW of the sheet P is heated to 90[° C.] and the black portion (K) of the toner images TA is heated to 110[° C.]. When the black portions of the toner images TA exist on both surfaces (+X side and −X side) of the sheet P, the temperature of the black portions is 130[° C.]. A yellow portion, a magenta portion and a cyan portion of the toner images TA have a lower temperature than that of the black portion. This is because heat absorptances by the respective colors (absorption efficiency by infrared rays) are different from one another. In FIG. 3, the preliminary heating unit 50 and the pressure roll 64 (see FIG. 2) on the rear side (−X side) of the sheet P are not illustrated.

The toner T adheres to the sheet P due to being melted by the heating of the preliminary heating unit 50 (in an attachment state where the toner is easily detached from the sheet P as compared to a fixed state), and the waxes WX contained in the toner T are melted. Here, since the waxes WX and the binder resin of the toner T are different in compatibility therebetween, the binder resin of the toner T adheres to the sheet P. Meanwhile, the waxes WX are precipitated on the surface (toward the fixing roll 62) of the toner T to form a release film. In this manner, the toner T on the sheet P enters the fixing unit 60 while the binder resin and the release film are separated from each other.

Subsequently, as shown in FIG. 2, the toner images TA on the sheet P pass through two contact portions N of the fixing unit 60, and are heated and pressurized by the fixing rolls 62 and the pressure rolls 64 whose surface temperatures reach 120[° C.]. Accordingly, the toner images are fixed on the sheet P.

In the fixing device 40 according to the first exemplary embodiment, as the fixing roll 62 as an example of the fixing member, the fixing roll 62 including the outermost layer 62C including at least one selected from a group consisting of the hydrogenated nitrile rubber and the denatured hydrogenated nitrile rubber may be used. Accordingly, the fixing member having excellent wear resistance may be obtained. As a result, it is possible to suppress the occurrence of gloss non-uniformity in an image.

The preliminary heating unit 50 is assembled in addition to the fixing roll 62, and, thus, it is possible to suppress degradation in the outermost layer 62C including at least one selected from a group consisting of the hydrogenated nitrile rubber and the denatured hydrogenated nitrile rubber. Further, it is possible to suppress the occurrence of fracturing and damage.

That is, it is possible to suppress the occurrence of degradation, fracturing and damage of the outermost layer 62C while suppressing the occurrence of gloss non-uniformity due to the wearing-out of the outermost layer 62C.

Second Exemplary Embodiment

Next, examples of a fixing device and an image forming apparatus according to the second exemplary embodiment will be described. Components and portions that are basically the same as those in the aforementioned first exemplary embodiment will be assigned the same reference numerals as those in the first exemplary embodiment, and the description thereof will be omitted.

Figure 4:
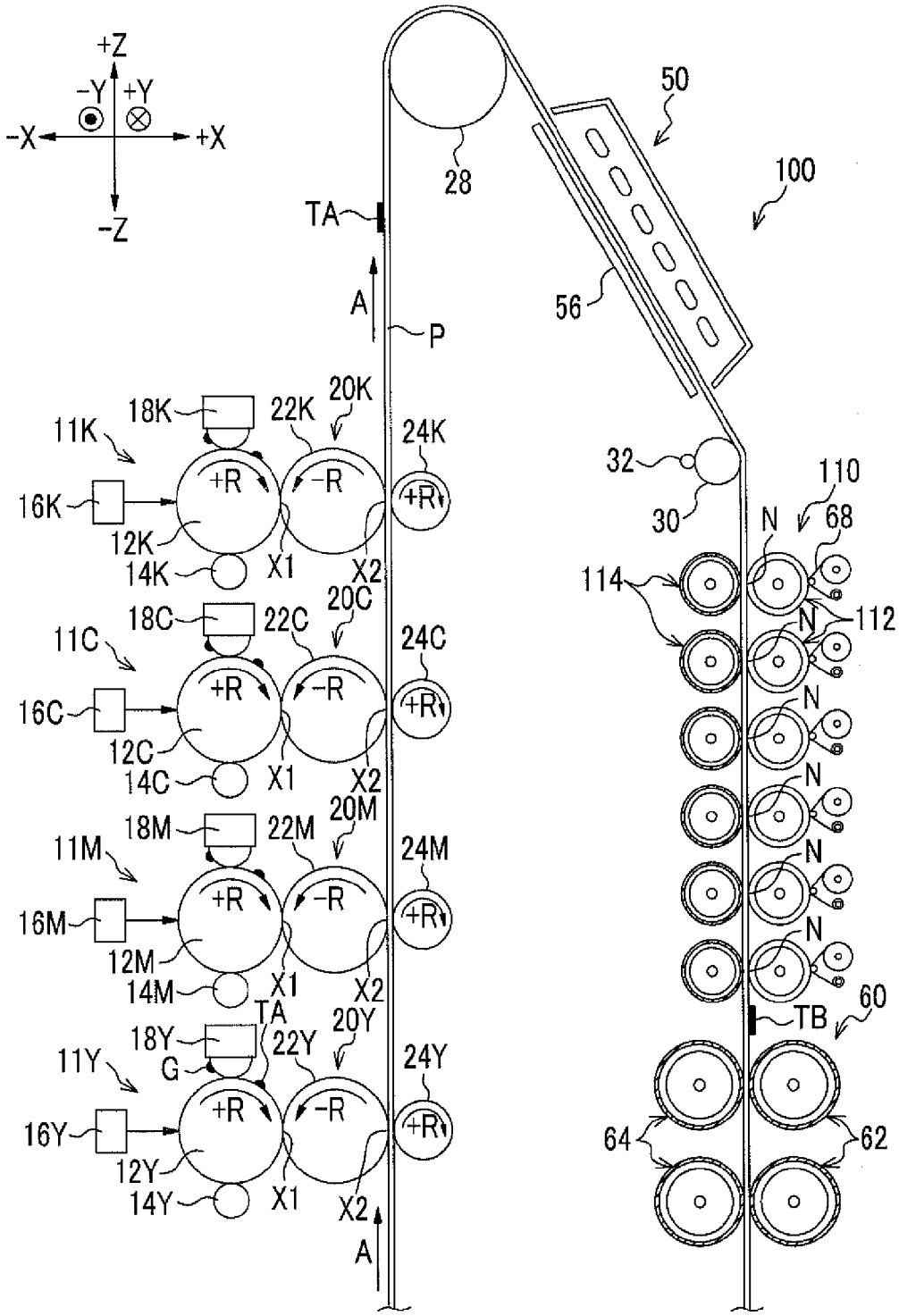
FIG. 4 is a schematic diagram showing the entire configuration of an image forming apparatus according to a second exemplary embodiment.

FIG. 4 shows a fixing device 100 according to the second exemplary embodiment. The fixing device 100 has the configuration in which the temperature converging unit 110 is provided between the winding roll 30 and the fixing unit 60 in the image forming apparatus 10 according to the first exemplary embodiment (see FIG. 1).

Temperature Converging Unit

Figure 5:
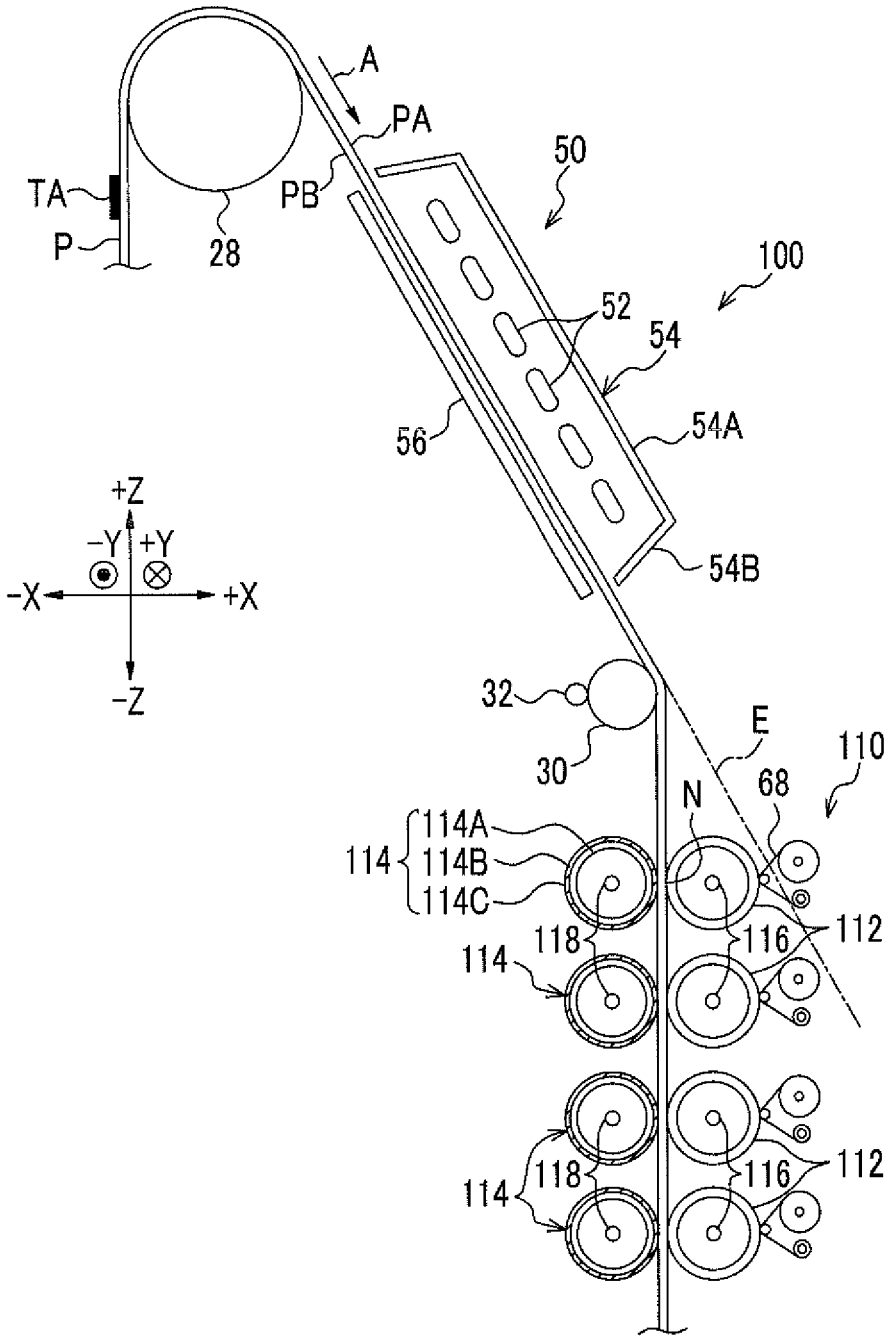
FIG. 5 is a schematic diagram showing the configuration of a temperature converging unit according to the second exemplary embodiment.

As shown in FIG. 5, the temperature converging unit 110 includes metal rolls 112 as examples of pre-fixing processing members, facing rolls 114, halogen heaters 116 that heat the metal rolls 112, and halogen heaters 118 that heat the facing rolls 114. The temperature converging unit 110 includes cleaning webs 68 that come in contact with outer circumferential surfaces of the metal rolls 112. In the present exemplary embodiment, the toner images are distinguished by representing toner images whose temperatures are converged by the temperature converging unit 110 as toner images TB (see FIG. 4) and representing toner images before the temperatures are converged as toner images TA.

Metal Roll

For example, the metal roll 112 has the configuration in which hubs made from SUS are provided at both ends of a pipe member made from SUS in an axial direction, and has an outer diameter of 80 [mm], a thickness of 2.5 [mm] in a radial direction and a length of 580 [mm] in the axial direction. The metal rolls 112 are arranged on a downstream side of the winding roll 30 in the transport direction of the sheet P (upstream side of the fixing roll 62 (see FIG. 4)) and on the +X side of the sheet P to be rotated with the Y direction as an axial direction. Thus, as an example of a pre-fixing process, the metal rolls 112 come in contact with the toner images TA to converge the temperatures of the sheet P and the toner images TA on a set temperature. Six metal rolls 112 are provided in the transport direction (Z direction) of the sheet P with an equal distance therebetween, and the halogen heaters 116 are respectively provided inside the metal rolls 112.

The transport path of the sheet P is bent by the winding roll 30, and, thus, the metal rolls 112 are arranged on the +X side of the sheet P in the Z direction and are closer to the −X side than the aforementioned extension line E. The metal rolls 112 collect the waxes WX by coming in contact with the toner images TA (see FIG. 3). The winding roll 30 positions an outer circumferential surface of the metal roll 112 in the first stage to be closer to the image surface PA than the extension line E. The first metal roll 112 refers to the metal roll 112 positioned closest to the winding roll 30.

Facing Roll

The facing rolls 114 have a cylindrical shape, and are arranged on the −X side of the sheet P to be rotated with the Y direction as an axial direction. The facing roll 114 has a multi-layer structure including a core roll 114A, an elastic layer 114B and an outermost layer 1140 from the inside toward the outside in a radial direction. The facing rolls 114 are urged toward the metal rolls 112 by urging units such as springs (not shown) Six facing rolls 114 are provided in the transport direction (Z direction) of the sheet P with an equal distance therebetween, and the halogen heaters 118 are respectively provided inside the facing rolls 114.

The core roll 114A has the configuration in which hubs made form SUS are provided at both ends of a pipe member made from an aluminum alloy in an axial direction. The elastic layer 114B is made from, for example, a silicone rubber having a thickness of 2.5 [mm] in a radial direction and a shore A hardness of A30. The outermost layer 1140 is made from, for example, PFA having a thickness of 100 [μm] in a radial direction. For example, the facing roll 114 has an outer diameter of 80 [mm] and a length of 580 [mm] in an axial direction.

While the metal rolls 112 and the facing rolls 114 come in contact with each other to sandwich the sheet P therebetween, the sheet P is transported, and the metal rolls and the facing rolls are driven-rotated. Portions (portions where the sheet P is interposed) where the metal rolls 112 and the facing rolls 114 come in contact with each other when the sheet P does not exist are described as contact portions N.

Halogen Heater

The halogen heaters 116 are inserted inside the metal rolls 112 in the Y direction one by one. Each of the halogen heaters 116 generates heat by applying electricity from the power supply (not shown) to heat the metal roll 112 from the inside. For example, the halogen heater 116 is feedback-controlled based on an output of a temperature sensor (not shown) that detects a temperature of the metal roll 112 such that a temperature of the outer circumferential surface of the metal roll 112 is 120[° C.]

The halogen heaters 118 are respectively inserted inside the facing rolls 114 in the Y direction. Each of the halogen heaters 118 generates heat by applying electricity from the power supply (not shown) to heat the facing roll 114 from the inside. For example, the halogen heater 118 is feedback controlled based on an output of a temperature sensor (not shown) that detects a temperature of the facing roll 114 such that an outer circumferential surface of the facing roll 114 is maintained at a temperature of 120[° C.].

The six metal rolls 112 are movable to the −X side (contact side) and the +X side (retracting side) by a latch mechanism (not shown) with positions where the outer circumferential surfaces are separated from the sheet P as original positions. Similarly, the six facing rolls 114 are movable to the +X side (contact side) and the −X side (retracting side) by a latch mechanism (not shown) with positions where the outer circumferential surfaces are separated from the sheet P as original positions.

When the fixing is performed by the fixing unit 60 (see FIG. 4), the latch mechanism (not shown) moves the six metal rolls 112 to the −X side from the original positions, and moves the six facing rolls 114 to the +X side from the original positions. Thus, the sheet P is interposed between the metal rolls and the facing rolls. When the fixing is not performed by the fixing unit 60, the latch mechanism moves the six metal rolls 112 to the +X side from the contact portions N, and moves the six facing rolls 114 to the −X side from the contact portions N. Thus, the rolls are retracted from the sheet P.

The halogen heaters 116 and the cleaning webs 68 are moved while maintaining an arrangement for the metal rolls 112, and the halogen heaters 118 are moved while maintaining an arrangement for the facing rolls 114. A load is applied to the contact portions N where the metal rolls 112 and the facing rolls 114 come in contact with each other in a steady load manner, and a load value is, for example, 735 [N].

Operation

Next, an operation of the second exemplary embodiment will be described.

As shown in FIG. 4, the toner images TA formed on the sheet P are heated by the preliminary heating unit 50, and enter the temperature converging unit 110 while the binder resin and the release film are separated from each other.

Subsequently, in the temperature converging unit 110, the sheet P passes through the six contact portions N, and, thus, the temperatures of the sheet P and the toner images TA which have a large temperature difference are gradually converged on the set temperature (for example, 120[° C.]). In this case, since the release film (release layer) formed by the waxes WX (see FIG. 3) exists on the surface of the toner images TA, offsetting of the toner T (see FIG. 3) onto the metal rolls 112 does not easily occur.

As stated above, since the metal rolls 112 are pipe members made from SUS, a temperature history does not easily remain. In the temperature converging unit 110, since the six pairs of metal rolls 112 and facing rolls 114 are arranged, when proceeding to a downstream side in the transport direction of the sheet P, a temperature difference between the toner images TA of the respective colors is reduced (see FIGS. 6A and 6B to be described below). In this manner, in the temperature converging unit 110, the temperatures of the toner images TA on the sheet P are converged on the set temperature. Since the waxes WX adhering to the outer circumferential surfaces of the metal rolls 112 are removed by the cleaning webs 68, the waxes are prevented from adhering to the sheet P.

Thereafter, the toner images TB in which the temperatures of the respective color portions are converged on the set temperature are heated and pressurized in the fixing unit 60, and, thus, the toner images TB are fixed on the sheet P. Since the temperatures of the respective color portions of the toner images TB are converged on the set temperature (a temperature difference in a width direction perpendicular to the transport direction is reduced), the respective color portions of the fixed toner images on the sheet P have substantially the same glossiness.

Figure 6A:
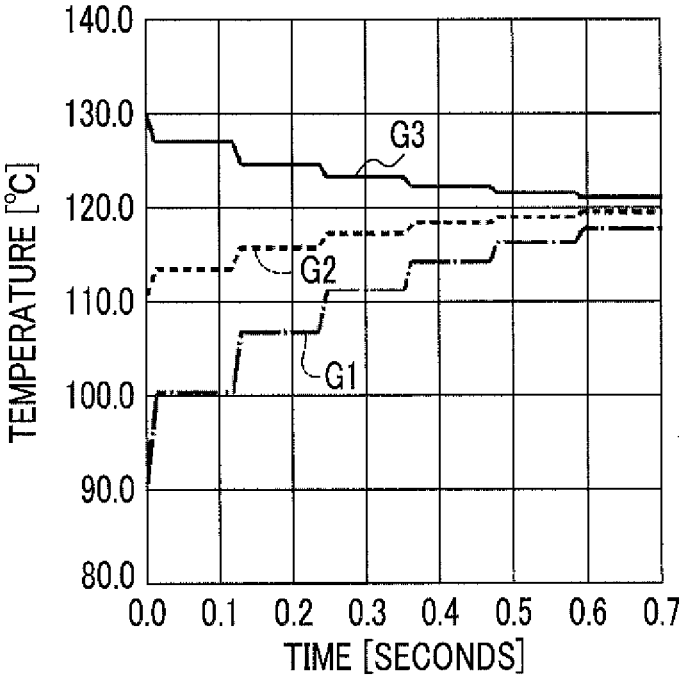
FIG. 6A are graphs showing temperature converging states of a white background portion, a one-sided toner portion and both-sided toner portions with time when a width of a contact portion according to the second exemplary embodiment is 5 mm and a set temperature is 120° C.

FIG. 6A shows temperature changes of the respective portions with time when a width of one contact portion N in the transport direction of the sheet P is set to 5 [mm] and a set temperature (converging target temperature) is set to 120[° C.]. In FIG. 6A, a graph G1 represents a temperature of the white background portion PW (see FIG. 3) of the sheet P, and a graph G2 represents a temperature of the black portion (one-sided toner portion) of only one side of the sheet P. A graph G3 represents a temperature of the black portions (both-sided toner portions) of both sides of the sheet P.

Figure 6B:
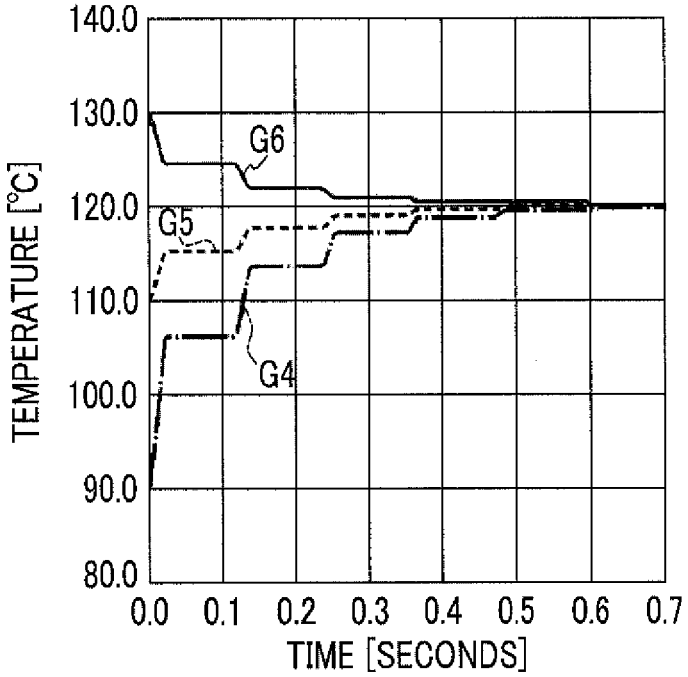
FIG. 6B are graphs showing temperature converging states of a white background portion, a one-sided toner portion and both-sided toner portions with time when a width of a contact portion according to the second exemplary embodiment is 15 mm and a set temperature is 120° C.

FIG. 6B shows temperature changes of the respective portions with time when a width of one contact portion N (see FIG. 2) in the transport direction of the sheet P is set to 15 [mm] and a set temperature (converging target temperature) is set to 120[° C.]. In FIG. 6B, a graph G4 represents a temperature of the white background portion PW (see FIG. 3) of the sheet P, and a graph G5 represents a temperature of the black portion (one-sided toner portion) of only one side of the sheet P. A graph G6 represents a temperature of the black portions (both-sided toner portions) of both sides of the sheet P.

The respective temperatures are calculated values obtained by calculating heat conduction. In the graphs G1, G2, G3, G4, G5 and G6, there are six time sections in which the temperatures are hardly changed (stabilized), but these time sections correspond to temperatures of the sheet P during a period until the sheet reaches the next contact portion N after passing the contact portion N. The temperatures of the sheet P are actually measured using a radiation thermometer in these regions, and it is determined whether or not the measured temperatures correspond to the calculated values.

As shown in FIG. 6A, when the width of the contact portion (see FIG. 2) is 5 [mm], even though the sheet P passes through the six contact portions N, the temperatures of the respective portions are not converged on 120[° C.]. Meanwhile, as shown in FIG. 6B, when the width of the contact portion N is 15 [mm] it may be seen that the temperatures of the respective portions are converged on 120[° C.] when the sheet P passes through the six contact portions N. That is, the width of the contact portion N and the number of contact portions are adjusted, and, thus, it may be seen that the temperatures of the respective portions on the sheet P may be converged on the set temperature.

The present invention is not limited to the aforementioned exemplary embodiment and a modification example.

Preliminary Heating Unit

The preliminary heating unit 50 is not limited to the carbon heaters 52 shown in FIGS. 1, 2, 4 and 5, and at least one selected from a group consisting of a heating member that heats the sheet P (recording medium) in a non-contact manner, a heating member that comes in contact with a rear surface (non-image surface PB) of the surface of the sheet P (recording medium) which holds the toner images TA (developer images) to heat the sheet, and a heating member (heating roll) that comes in contact with a surface (image surface PA) of the sheet P (recording medium) which holds the toner images TA (developer images) with a lower pressurizing pressure than that of the fixing roll 62 (fixing member) to heat the sheet may be applied.

Figure 7:
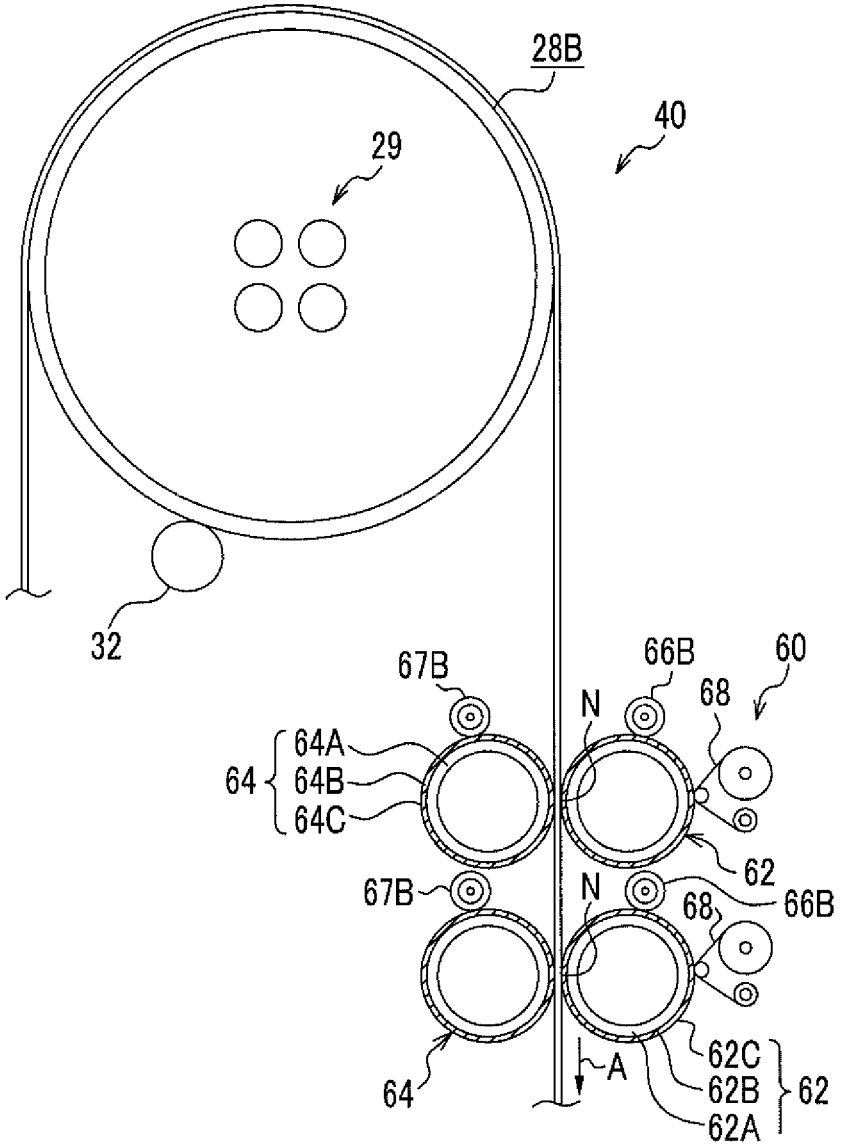
FIG. 7 is a schematic diagram showing the configuration of a modification example of the fixing device.

Specifically, an aspect in which a heating member that comes in contact with a rear surface (non-image surface PB) of the surface of the sheet P (recording medium) which holds the toner images TA (developer images) to heat the sheet is provided will be described with reference to FIG. 7. FIG. 7 is a diagram showing an aspect in which a transport roll 28B including halogen heaters 29 (6 kW×4) therein is provided as a preliminary heating unit.

The transport roll 28B is disposed on a downstream side of the four image forming units 11Y, 11M, 11C and 11K and an upstream side of the fixing unit 60 in the transport direction of the sheet P to come in contact with the non-image surface PB of the sheet P. The halogen heaters 29 included within the transport roll 28B generate heat by applying electricity from the power supply (not shown) to heat the transport roll 28B from the inside. For example, the halogen heater 29 is feedback-controlled based on an output of a temperature sensor (not shown) that detects a temperature of the sheet P such that the sheet P is maintained at a temperature of 120[° C.]. The outer circumferential surface of the cleaning roll 32 as an example of a cleaning unit comes in contact with an outer circumferential surface of the transport roll 28B.

A time for which the transport roll 28B comes in contact with the recording medium is preferably equal to or greater than 0.3 s, and is more preferably equal to or greater than 0.5 s. Thus, when the transport speed of the sheet P is, for example, 60 m/min (1 m/s), an outer diameter of the transport roll 28B is preferably equal to or greater than 320 mm. The transport roll 283 shown in FIG. 7 is a roll having an outer diameter of 400 mm. The transport roll 28B shown in FIG. 7 has a length of 580 mm and a thickness of 8 mm, and is made from an aluminum alloy (A5052).

An operation of the transport roll 283 shown in FIG. 7 will be described.

As shown in FIG. 7, the transport of the sheet P is started by the rotation of the transport roll 28B, and the halogen heaters 29 within the transport roll 28B are heated. The toner images TA are formed on the sheet P in the image forming units 11Y, 11M, 11C and 11K, and the toner images TA on the sheet P are subsequently heated by the transport roll 28B as the preliminary heating unit, as shown in FIG. 7.

Since the transport roll 28B is a heating member that comes in contact with the rear surface of the surface of the sheet P which holds the toner images TA to heat the sheet, both of the white background portion of the sheet P and the toner images TA may be heated without non-uniformity. Accordingly, since it is possible to suppress a temperature difference on the sheet P due to the presence or absence of the toner images TA or a color difference between the toner images TA, the transport roll 28B is preferably used.

The transport roll 28B is controlled such that both of the white background portion PW of the sheet P and the toner images TA are 120[° C.].

The toner T is melted by the heating of the transport roll 28B as the preliminary heating unit to adhere to the sheet P (in an attachment state where the toner is easily detached from the sheet P as compared to a fixed state), and the waxes WX contained in the toner T are also melted. Here, since the waxes WX and the binder resin of the toner T are different in compatibility therebetween, the binder resin of the toner T adheres to the sheet P. Meanwhile, the waxes WX are precipitated on the surface (toward the fixing roll 62) of the toner T to form a release film. In this manner, the toner T on the sheet P enters the fixing unit 60 while the binder resin and the release film are separated from each other.

As another aspect of the preliminary heating unit, a heating member, such as a quartz lamp, a flash lamp or an oven heater, which heats the sheet P (recording medium) in a non-contact manner may be used.

For example, as a heating member that comes in contact with the surface (image surface PA) of the sheet P (recording medium) which holds the toner images TA (developer images) with a lower pressurizing pressure than that of the fixing roll 62 (fixing member) to heat the sheet, an aspect in which a heating roll comes in contact with the sheet with a lower pressurizing pressure than that of the fixing roll 62 is used.

Even when the carbon heaters 52 are used, the number of carbon heaters 52 is not limited to six, and may be various numbers. The preliminary heating unit 50 may have or may not have the reflection plate 56.

The toner T is not limited to the polyester resin, and may be another resin.

Fixing Unit

The heat supplying unit in the fixing roll 62 is not limited to the halogen heaters 66 arranged therein as shown in FIGS. 1, 2 and 4. For example, the heat supplying unit may be an external heat supplying unit that comes in contact with the outermost layer 62C from the outside of the fixing roll 62 to supply heat to the fixing roll.

Specifically, an aspect of the fixing unit including an external heat supplying unit that comes in contact with the outermost layer 62C from the outside of the fixing roll 62 to supply heat to the fixing roll will be described with reference FIG. 7. FIG. 7 is a diagram showing an aspect of the fixing unit including an external heat supplying unit that comes in contact with the fixing roll 62 to supply heat to the fixing roll from the outside as the heat supplying unit.

Outer circumferential surfaces of heat supplying rolls 663 as examples of the external heat supplying units come in contact with the outer circumferential surfaces of the fixing rolls 62 shown in FIG. 7, For example, a rubber material including a heat-resistant release layer on an outer circumferential surface of a core bar made from SUS is provided at the heat supplying roll 66B. The heat supplying roll 66B is driven-rotated with the Y direction as an axial direction by the rotation of the fixing roll 62. A halogen heater is provided inside the heat supplying roll 66B, and the halogen heater generates heat by applying electricity from the power supply to heat the heat supplying roll 66B from the inside. For example, the heat supplying roll 66B is feedback-controlled based on an output of a temperature sensor (not shown) that detects a temperature of the fixing roll 62 such that a temperature of the outer circumferential surface of the fixing roll 62 is maintained at 120[° C.].

In the pressure rolls 64 shown in FIG. 7, outer circumferential surfaces of heat supplying rolls 67B as examples of the heat supplying units come in contact with the outer circumferential surfaces. Since the heat supplying roll 67B has the same configuration as that of the heat supplying roll 66B, the description thereof will be omitted.

The fixing unit 60 is not limited to a roll system using the fixing rolls 62 and the pressure rolls 64, and may be a belt system. The fixing unit 60 is not limited to a system using two pairs of rolls, and may be a system using a pair of rolls or three or more pairs of rolls.

Temperature Converging Unit

The material of the metal rolls 112 is not limited to SUS, and may be an aluminum alloy or another metal. For example, when the metal roll is made from an aluminum alloy, a thickness of the pipe member is preferably about 7.5 [mm] in consideration of bending of the rolls. In order to improve releasability, a fluororesin of approximately several tens of [μm] may be formed on the surface of the metal roll 112. The metal roll 112 is not limited to a roll that is rotated by the movement (transport) of the sheet P, and may be driven by a motor. The facing roll 114 may be a non-rotated fixed member.

The bending member is not limited to the rotating member such as the winding roll 30, and may be a fixed member that is fixed to the apparatus main body to allow the sheet P to slide. In the winding roll 30, when the adhering of the foreign substances is not a problem, the cleaning roll 32 may not be provided. The winding roll 30 is not limited to a roll that is driven-rotated, and may be a driving roll rotated by a motor (driving source). When the winding roll 30 is a driving roll, rubber may be provided at an outer circumferential portion.

EXAMPLES

Hereinafter, the present invention will be more specifically described in conjunction with examples and comparative examples, but the present invention is not limited to the following examples.

Example 1

An elastic layer made from a vinylmethyl silicone rubber is formed on a core roll made from an aluminum alloy (A5052).

Subsequently, a coating liquid is obtained by preparing a hydrogenated nitrile rubber (HNBR, Zetpol 2020L manufactured by ZENON CORPORATION) and carbon black particles (the amount becomes an addition amount of 25% by weight after drying) and mixing both of the hydrogenated nitrile rubber and the carbon black particles with a liquid for coating. A fixing roll (ϕ148 mm) is obtained by coating the elastic layer with the coating liquid to dry the coating liquid on the elastic layer and volatilizing the liquid to form the outermost layer.

Evaluation Tests

The following evaluation tests are performed by using the image forming apparatus shown in FIG. 1, using descriptions in Table 1 that represent the presence or absence of the preliminary heating unit 50 as conditions, attaching the fixing roll obtained above, and forming an image of 10 km on roll sheet of OK topcoat 127 gsm.

Fracturing of Outermost Layer

When the image is formed, a process in which the image formation is stopped at an interval of 1 km, the fixing device is stopped and the image formation is restarted is repeated, and it is checked whether or not the fracturing had occurred in the outermost layer of the fixing roll.

Gloss Non-Uniformity

It is checked whether or not the gloss non-uniformity had occurred in the image when the image formation of 10 km is finished.

Example 2 and Comparative Examples 1 and 2

A fixing roll is obtained similarly to Example 1 except that the hydrogenated nitrile rubber (HNBR) in Example 1 is changed to materials described in Table 1 below.

Comparative Example 3

A fixing roll is obtained similarly to Example 1 except that the preliminary heating unit 50 in Example 1 is not provided, and is evaluated.

TABLE 1

| | | Example 1 | Example 2 | Comparative Example 1 | Comparative Example 2 | Comparative Example 3 |
|---|---|---|---|---|---|---|
| Outermost Layer | | HNBR | Denatured HNBR | PFA | FKM | HNBR |
| Preliminary Heating Unit | | Present | Present | Present | Present | Absent |
| Evaluation | Outermost-Layer Fracturing | Absent | Absent | Absent | Absent | Present |
| | Gloss Non-uniformity | Absent | Absent | Present | Present | (No Evaluation) |

The details of the respective materials described in Table 1 are follows.

HNBR (hydrogenated nitrile rubber, Zetpol 2020L manufactured by ZENON CORPORATION)

Denatured HNBR (denatured hydrogenated nitrile rubber, Zeoforte ZSC2295C manufactured by ZENON CORPORATION)

PFA (tetrafluoroethylene-perfluoroalkylvinylether copolymer, product name: P-66P manufactured by ASAHI GLASS CO., LTD)

FKM (vinylidene fluoride-based rubber, product name: F960 manufactured by DAIKIN INDUSTRIES, Ltd.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit that includes a pipe-shaped fixing member which includes an outermost layer including at least one selected from a group consisting of a hydrogenated nitrile rubber and a denatured hydrogenated nitrile rubber, and heats and pressurizes the recording medium to fix an unfixed developer image on a recording medium by bringing the outermost layer into contact with a surface of the recording medium which holds the developer image, the recording medium being transported while holding the unfixed developer image; and a heating unit that is disposed on an upstream side of the fixing unit in a transport direction of the recording medium, and heats the recording medium transported while holding the unfixed developer image, the heating unit heating by at least one heating member selected from a group consisting of a heating member that heats the recording medium in a non-contact manner, a heating member that comes in contact with a surface opposite to the surface of the recording medium which holds the developer image to heat the recording medium, and a heating member that comes in contact with the surface of the recording medium which holds the developer image with a pressurizing pressure lower than a pressurizing pressure of the fixing member to heat the recording medium, wherein a temperature of a lowest-temperature portion of the recording medium of the following (A) or (B) is equal to or greater than [a set temperature of the fixing member−30° C.] and is equal to or less than 140° C. when the following case (a) or (b) is satisfied, (a) when a member that exchanges heat with the recording medium is provided on an upstream side of the fixing unit and a downstream side of the heating unit in the transport direction of the recording medium: (A) the recording medium before coming in contact with the fixing member after the heat is exchanged by the member, (b) when a member that exchanges heat with the recording medium is not provided on an upstream side of the fixing unit and a downstream side of the heating unit in the transport direction of the recording medium: (B) the recording medium before coming in contact with the fixing member after heating by the heating unit.

2. The fixing device according to claim 1, wherein the fixing unit includes an external heat supplying unit that comes in contact with the outermost layer from an outside of the fixing member to supply heat to the fixing member, as a unit that supplies heat to the fixing member, and does not include an internal heat supplying unit that supplies heat from an inside of the fixing member.

3. An image forming apparatus comprising:

the fixing device according to claim 1; and a developer image forming unit that forms the unfixed developer image on the recording medium transported to the heating unit.

4. The image forming apparatus according to claim 3, wherein the fixing unit is hollow or solid.

5. The fixing device according to claim 1, wherein the fixing unit is hollow or solid.

6. A fixing device comprising:

a fixing unit that includes a pipe-shaped fixing member which includes an outermost layer including at least one selected from a group consisting of a hydrogenated nitrile rubber and a denatured hydrogenated nitrile rubber, and heats and pressurizes the recording medium to fix an unfixed developer image on a recording medium by bringing the outermost layer into contact with a surface of the recording medium which holds the developer image, the recording medium being transported while holding the unfixed developer image; and a heating unit that is disposed on an upstream side of the fixing unit in a transport direction of the recording medium, and heats the recording medium transported while holding the unfixed developer image, the heating unit heating by at least one heating member selected from group consisting of a heating member that heats the recording medium in a non-contact manner, a heating member that comes in contact with a surface opposite to the surface of the recording medium which holds the developer image to heat the recording medium, and a heating member that comes in contact with the surface of the recording medium which holds the developer image with a pressurizing pressure lower than a pressurizing pressure of the fixing member to heat the recording medium; and a temperature converging unit provided between the heating unit and the fixing unit.

* * * * *